US006164290A

United States Patent [19]

Andrews

[11] Patent Number: 6,164,290

[45] **Date of Patent: *Dec. 26, 2000**

[54] DOUBLE-SIDED SAFETY STRAIGHT RAZOR

[76] Inventor: Edward A. Andrews, 6835 Beach Rd., Troy, Mich. 48098

[ * ] Notice: This patent is subject to a terminal disclaimer.

[21] Appl. No.: 09/365,959

[22] Filed: Aug. 2, 1999

Related U.S. Application Data

[63] Continuation-in-part of application No. 09/168,817, Oct. 8, 1998, Pat. No. 5,934,291, which is a continuation-in-part of application No. 08/944,603, Oct. 6, 1997, Pat. No. 5,908,036, which is a continuation-in-part of application No. 08/515,832, Aug. 16, 1995, Pat. No. 5,673,711, which is a continuation-in-part of application No. 08/319,149, Oct. 6, 1994, Pat. No. 5,479,950, which is a continuation of application No. 08/020,586, Feb. 22, 1993, abandoned.

[51] Int. Cl.[7] ..... A45D 2/50; B26B 21/00

[52] U.S. Cl. ..... 132/215; 132/289; 30/30; 30/32; 30/84; 30/85

[58] Field of Search ..... 132/148, 289, 132/214, 215; 30/30, 32, 48, 49, 55, 58, 76, 84, 85

[56] References Cited

U.S. PATENT DOCUMENTS

| | | | |
|---|---|---|---|
| 4,344,226 | 8/1982 | Blake, III | 30/30 |
| 4,663,841 | 5/1987 | Custer | 30/30 |
| 4,782,590 | 11/1988 | Pope | 30/30 |
| 4,928,716 | 5/1990 | Greene | 132/212 |
| 5,161,307 | 11/1992 | Althaus | 30/77 |
| 5,220,728 | 6/1993 | Ueno et al. | 30/30 |
| 5,908,036 | 6/1999 | Andrews | 132/215 |
| 5,934,291 | 8/1999 | Andrews | 132/215 |

*Primary Examiner*—Pedro Philogene
*Attorney, Agent, or Firm*—Harness, Dickey & Pierce, P.L.C.

[57] ABSTRACT

In-line manual razor blade shaving devices feature an elongated frame having an elongated front cutter support portion arranged in-line with an elongated handle portion. The cutter support portion has first and second opposed sides upon which elongated razor blade structures, such as dual razor blade cartridges, are mounted. The elongated razor blade structures each feature at least one razor blade strip spaced from and arranged generally parallel to elongated front and rear guard portions. The guards define a working plane into which the razor blade edges of the razor blade structure project. The new in-line safety straight razors of the present invention may be utilized in a manner very much like the old unguarded in-line straight razor devices long used by barbers, except that front and rear guard portions help shield the exposed razor-sharp edges so as to minimize the occurrence of minor cuts, nicks and scrapes. The razor blades may be constructed from strips of flat metal alloy or other suitable material sharpened along one edge. The razor blades of the two razor blade structures on opposite sides of the front cutter support portion may be arranged to point slightly outwardly away from the central front cutter support portion, or they may be arranged to all point in the same direction, by virtue of the razor blade strips of the first and second razor blade head structures being arranged generally parallel to one another.

28 Claims, 6 Drawing Sheets

1000
2
1004
1006
1002
1012
2
1008
1010

1042
1034
1012
1010
1030
1052
1016
1060
1046
1054
1074
1038
1014
1048
1062
1040
1050
1018
1026
1066
1058
1032
1020
1068
1008
1028
1044
1072
1056
1024
1070
1022
1064
1036
1074
1028

1100
1112
1118
1110

1150
1162
1175
1160
1168
1170

DOUBLE-SIDED SAFETY STRAIGHT RAZOR

CROSS-REFERENCE TO RELATED APPLICATIONS

This application is a continuation-in-part of application Ser. No. 09/168,817 filed Oct. 8, 1998, now U.S. Pat. No. 5,934,291, which is a continuation-in-part of application Ser. No. 08/944,603 filed Oct. 6, 1997, now U.S. Pat. No. 5,908,036, which is a continuation-in-part application of Ser. No. 08/515,832 filed Aug. 16, 1995, now U.S. Pat. No. 5,673,711, which is a continuation-in-part application of Ser. No. 08/319,149 filed Oct. 6, 1994, now U.S. Pat. No. 5,479,950, which is a continuation of application Ser. No. 08/020,586 filed Feb. 22, 1993, now abandoned. The disclosures of all of my above-identified applications and patents are hereby incorporated herein by reference.

FIELD OF THE INVENTION

This invention relates in general to manual straight razor shaving devices with razor blade and handle arranged generally in line, and in particular to manual safety straight razor shaving devices having dual razor-sharp cutting edges positioned between front and rear guards, and an in-line handle which can easily be gripped for precise shaving of the face and other body surfaces.

BACKGROUND OF THE INVENTION

It has long been a common practice to shave facial hair using a straight edge razor with an in-line handle. For more than a century, barbers and individuals have been using such unguarded straight razors to shave hair from the face and other body regions. The hazards of using a straight razor, particularly in the hands of an unskilled user, are well-known—cuts and scrapes often resulted. This is one of the reasons many individuals over the years have preferred to use the services of a barber to obtain close shaves. In the United States, barbers have long been licensed professionals, and typically were trained in the use and care of a straight razor. Further, through experience, barbers in the United States and around the world have become quite adept at using straight razors and sharpening them with leather stopping belts.

In response to the perceived danger of using a straight razor in the hands of someone other than a barber, and difficulties in skillfully sharpening them, the now-classic T-bar razor blade device was developed over ninety years ago. The typical old-fashioned T-bar razor, such as is shown in U.S. Pat. No. 775,134 to K. C. Gillette, features a handle which is arranged perpendicularly to the major plane of the elongated razor blade head, and connected to the bottom of the razor blade head. Typically, the razor blade head used a replaceable double-sided razor blade, with one razor-sharp edge on either side of the head. Also, on each side of the razor head, a single elongated front guard was provided, and the razor-sharp edge of the razor blade on that side of the head was spaced a short distance back from the front guard. In this manner, the user could place the razor blade head structure adjacent to his skin, by first having the front guard contact the skin, and then carefully rotate the razor blade edge into contact with the skin to be shaved, before beginning of the stroke of the razor edge across the skin. This front guard helped reduce the likelihood of cuts and nicks, by giving a user a guard that also functioned as a guide to help safely present the razor blade edge to the face.

The steady series of improvements to the classic T-bar razor and resulting success of the T-bar razor architecture cannot be denied. Among those improvements was the use of two closely spaced parallel razor blade strips positioned with their razor-sharp edges between front and rear guards, which generally define a working plane for the blade edges, as is shown in U.S. Pat. No. 3,724,070 to F. W. Dorion, Jr. and U.S. Pat. No. 3,786,563 to Dorion, Jr. et al. This modern style twin-blade manual T-bar razor has been in wide use in the U.S. more than twenty years. This general style of razor has been undergoing still further improvements, as exemplified by the commercially available Gillette Sensor and Schick Tracer cartridge-based uni-directional razor blade systems. Modern T-bar razors have proven so popular they have supplanted almost all use of in-line straight razors for shaving by individuals. Now it seems that, at least in the United States, it is only the trained professionals, i.e., barbers with the requisite training and experience, who still give shaves to customers using an unguarded straight razor.

The advent of severe communicable diseases, particularly AIDS and the HIV virus, among others, has resulted in fewer barbers still willing to shave customers with straight razors—so much so that the use of straight razors, at least in the U.S., seems destined to be a dying art. Even trained professionals will from time to time accidentally cut, nick or scrape the skin of their customers with such razors, causing some minor bleeding. It is widely known that communicable diseases, particularly AIDS, the HIV virus and other serious viruses, reside in blood. Barbers and others, such as health-care workers, are understandably reluctant to come in contact with blood from others, and tend to avoid tasks where such contact is likely. This tendency has not prevented all professionals from routinely handling procedures where some minor bleeding may occasionally be encountered. In this regard, medical and dental procedures frequently involve exposure to a little bit of bleeding. In response, medical and dental workers now simply wear suitable protective garb. Such gear may include smocks, gloves made of synthetic latex rubber or other film-like plastics, eye shields, nose and mouth masks. Such gear helps ensure against even accidental contact of the blood of the customer or patient with their own bodies. Also, even with the now very safe modern T-bar razors, there is still a small risk of a minor cut or scrape, even with the razor blade edges positioned in the working plane established by closely spaced front and rear guards. Yet that has not stopped the sale of manual razors. Thus, it appears that there are at least some situations where a very minor amount of blood will be tolerated, both by professionals and at-home users of manual razor devices.

Obtaining a truly close comfortable shave is one major benefit of a shave from a barber skilled in the use of the straight razor. Some customers would no doubt like to have them. But they may not ask because they are fearful of contacting a communicable disease either through the barber cutting himself or the chance that there are blood droplets or germs from another earlier customer still be present on the straight razor. Such customers may be concerned that there are other sources of possible germ transmission as well. Most people appreciate that germs and viruses are exceedingly small and cannot be seen. They also know that some kinds of germs can be difficult to kill without the use of strong measures, like: (1) heating to high temperatures, such as in an autoclave; (2) using strong radiation (e.g., bright U-V light); or (3) using strong biological agents, such as liquid bactericide. While these methods are undoubtedly effective when properly carried out, there may well be customers who shy away asking for, and even many barbers who shy away from recommending, old-fashioned wet-lather shaves using a straight razor. Customers and barbers alike may be concerned about possible unsanitary practices associated with the cleaning and/or storage of the straight razors, which barbers will typically reuse many times with different customers. Even the leather stropping belts, used by barbers to sharpen straight razors, for the next customer, may be a source of possible germ transmission. In light of these concerns, the time-honored wet shave by a barber or an individual using an unguarded straight razor is one practice which may even die away.

In terms of past developments, there have been a number of patents issued on straight-razor devices. Some of these are directed toward solving one or more of the aforementioned problems of accidental cuts or of lowering possible disease transmission. In this regard, see the following U.S. patents:

| | |
|---|---|
| 2,866,984 to Plough; | 2,952,910 to Meohas; |
| 3,557,448 to Shead | 4,037,322 to Bresler; |
| 4,319,399 to Ciaffone; | 4,344,266 to Blake; |
| 4,622,742 to Lee | 5,009,003 to Grange |

For example, U.S. Pat. No. 4,622,742 to Lee discloses an in-line handle which was designed to be broken after a single use, and in this sense was disposable. U.S. Pat. No. 3,557,448 to Shead discloses a retractable razor blade holder to hold a standard straight-edge razor, thereby serving as a replacement for the straight razor commonly used by barbers and hair cutters. U.S. Pat. No. 5,009,003 to Grange discloses a razor that has an improved handle to improve ergonomics and hand control. However none of these three patents appears to provide mechanisms for avoiding cuts, nicks and scrapes while actually shaving. Some of the others disclose guards or shields, but these appear as though they would interfere with the closeness of the shaving process, since they are generally interposed between the skin and the razor-sharp edge of the straight razor.

There are still other patents, beyond those listed above, that also disclose a device for cutting hair using a straight razor blade and an in-line handle. However, common among all of them of which I am aware is a lack of the dual desired goals of obtaining an extremely close shave using a razor-sharp continuous straight-edge of a razor blade, coupled with guarding arrangements that permit a very safe, method of shaving. For example, as noted above, a number of relatively safe in-line razor devices having an in-line elongated handle for cutting hair which use finger-like guards extending over the razor-sharp edge of the elongated straight razor blade. Unfortunately, such devices are suitable for cutting hair or trimming mustaches or sideburns, and often were specifically designed for such purposes, but also were not apparently meant for close skin-shaving purposes. This is because the finger-like projections do not allow the razor-sharp blade edge to bear directly against the skin, thus preventing a truly close shave which is the hallmark of the classic unguarded in-line straight razor device.

Accordingly, there is still a need for solutions to the perceived problems of using a straight razor to provide a close wet shave, particularly as barbers used to routinely give them with straight razors. In particular, there is a continuing need for simple-to-construct, easy-to-use, preferably inexpensive and light-weight shaving devices for enabling barbers to safely and easily shave their customers' faces, including mustaches, goatees and sideburns, using the convenient straight edge razor blade arranged in-line with an elongated handle. Preferably, such new in-line razor blade devices would also address the aforementioned perceived problems with unguarded straight razors, and would be suitable for use by individuals to shave themselves, particularly their facial hair.

Thus, objects of the present invention include the following:

(1) To provide an easy-to-use in-line straight razor shaving device for safely and closely shaving hair stumbled from the face and other parts of the body when the hair stubble is wet and lathered with shaving soap or cream;

(2) To provide an in-line razor shaving device which minimizes the chance of accidentally cutting, nicking or scraping the skin with the razor-sharp edge of the straight razor blade, safety guards to shield the razor blade edge, (3) To provide an in-line razor shaving device which is sufficiently inexpensive so that it may be discarded when the razor blade becomes dull or used, and replaced with a new, sharp and sanitary razor blade edge, preferably provided in a removable, replaceable cartridge form;

(4) To provide an in-line safety straight razor shaving device having the plane of the razor blade or blades disposed at an angle substantially parallel to the opposed sides of the forward cutter portion of the device, thus permitting the device to be used like old-fashioned unguarded straight razors;

(5) To provide an in-line shaving device which features more than one straight razor blade on the razor head, including razor blades on two opposed sides of the forward cutter portion of the device, with the dual razor blade strips on each opposed side; and (6) To provide an in-line shaving device which is easy and inexpensive to manufacture, using materials and components found in conventional manual razors in wide use today.

SUMMARY OF THE INVENTION

To address the foregoing problems, the present invention provides an in-line safety straight razor shaving device having an elongated handle arranged generally in-line with an elongated razor head having a new combination of features. In accordance with a first aspect of the present invention, an in-line double-sided manual shaving safety straight razor blade device is provided for shaving of the face or other areas of the body. It features a single safety head connected to and supported by a handle portion arranged generally in-line therewith. The razor device preferably comprises: an elongated frame having an elongated front cutter support portion and an elongated rear handle portion; and first and second elongated razor blade structures respectively mounted upon the first and second sides of the front cutter support portion in generally opposed relation. The front cutter and rear handle portions each preferably have a longitudinal axis, with the two longitudinal axes arranged generally in-line. This in-line arrangement is minimally accomplished by having the axes of the cutter support portion and rear handle portion being generally located in a common plane, which means the cutter portion may be offset from the elongated handle or grip portion. It may be also accomplished by having the two axes arranged along a common line, so that the cutter portion and handle portion are not substantially offset from one another.

The front cutter support portion preferably has first and second sides arranged on either side of the common plane in which the longitudinal axes lie. The first and second sides are preferably substantially parallel to one another. The first and second elongated razor blade structures are attached to these first and second sides, and accordingly, only one of the first and second razor blade structures may be in use at any one time.

Each razor blade structure includes at least a first elongated razor blade having a substantially continuous razor-sharp edge and elongated front and rear guards spaced from each other and the razor-sharp blade edge. Each of the elongated razor blade structures preferably includes a second elongated razor blade having a razor-sharp edge. The razor blades are preferably constructed as very thin flat razor blade strips, and their razor-sharp edges are preferably straight. The razor-sharp edge of the second blade is preferably spaced from and generally parallel to: (i) the razor-sharp edge of the first razor blade and (ii) the front and rear guards. The elongated front and rear guards of each razor blade structure preferably define a working plane into which the razor-sharp edges of the first and second razor blade strips just barely project.

In one preferred construction of the in-line safety razor blade devices of the present invention, first and second razor blade structures are constructed as a single removable cartridge. In this embodiment, the front guards of the first and second razor blade structures are preferably formed from the same unitary elongated guard member that preferably forms the lower portion of the front cutter support portion. The front guard of the first razor blade structure comprises about one-half of the unitary guard member and the front guard of the second razor blade structure comprises about another, opposite, half of the unitary guard member. In another preferred embodiment, the first and second razor blade structures are constructed as separate opposed razor blade cartridges, which may be removed and replaced periodically when the razor blade edge is dull or spent.

The arrangements of the razor blades may be varied, in terms of their relative orientation to the first and second sides of the front cutter support portion. The blades on opposite sides of the front cutter support portion may be arranged to point slightly outwardly away from the central front cutter support portion, or they may be arranged to all point in the same direction. Specifically, as to the first arrangement, these flat blade planes may be generally tilted somewhat upwardly away from the front guard toward the rear guard, so that the blade planes intersect along an imaginary line located in the common plane. The tilt of the blade planes is relatively slight, preferably on the order of 10 to 35 degrees, so that the imaginary line of intersection is generally rearwardly of the elongated rear guards, or maybe outside of the front cutter support portion altogether. As to the second arrangement, the planes of the flat first razor blade strips of the first and second razor blade structures may be arranged very nearly parallel, or exactly parallel, to one another.

According to a second aspect of the present invention, there is provided an in-line manual shaving safety straight razor blade device, having a single head with at least dual razor-sharp blade edges, connected to and supported by a handle portion arranged generally in-line therewith, for shaving of the face or other areas of the body. This razor device minimally comprises: an elongated frame having an elongated front cutter support portion and an elongated rear handle portion; and at least a first elongated razor blade structure being connected to and supported by the front cutter support portion. If desired, the front cutter support portion and the rear handle portion may be generally arranged as before, with their longitudinal axes arranged generally in-line by virtue of the axes of the cutter support portion and rear handle portion generally being located in the same plane. Again, the front cutter support portion preferably has first and second sides, with the first elongated razor blade structure being located on a first side thereof. In its simplest form, this in-line shaving device has only one razor blade structure having a single blade razor blade strip. In other words, there need not be: (i) a second razor blade structure on the second side of the front cutter support portion, or (ii) even two razor blade strips in the single razor blade structure. However, this single straight razor blade structure preferably does include first and second elongated straight razor blades each having razor-sharp blade edges, with the second razor blade edge being spaced from and generally parallel to the first razor blade edge. Also, this straight razor blade structure further includes: an elongated front guard member spaced from the razor-sharp blade edges, and an elongated rear guard member spaced from the razor-sharp blade edges and from the front guard member. This simplified device may have the longitudinal axes of the front cutter portion and the rear handle portion offset from one another in the same plane, or the axes may be arranged to be essentially along a common line. In all versions of present invention, the razor blades may be constructed from strips of flat metal alloy or other suitable material sharpened along one edge. The first and second elongated razor blades are preferably each formed from substantially flat, very thin, substantially rectangular strips of metal alloy having two parallel sides.

Those skilled in the art will appreciate that the safety straight razors of the present invention may be provided with a reusable handle and a disposable straight razor head, preferably constructed as an easily removable cartridge. In this manner, a significantly more expensive handle may be used with a less expensive razor head. One advantage of replacement of the razor blade head is that this enables the user to always have a device with a sharp razor edge whenever it is used, thereby providing optimum cutting and trimming performance.

My shaving devices are sufficiently inexpensive in construction that each one, or at least its disposable razor blade cartridge, may be readily discarded and replaced after a limited number of uses, thus providing the user with a device having a new, sharp razor edge. Similarly, a barber can now afford to offer each customer desiring a close safe shave with a straight razor a brand-new safety razor blade cartridge never before used. In accordance with a preferred method of the present invention, a barber removes the new, unused in-line straight razor cartridge from its sanitary package directly in front of the customer, and then mounts it upon a reusable in-line elongated razor blade handle. Preferably, the sanitary package is made of a transparent liquid-impermeable flexible plastic material, and is heat-sealed or otherwise hermetically sealed while in a clean environment. If desired, after being sealed, the sanitary package may be subjected to suitable radiation, such as gamma radiation, to kill any germs or viruses still resident therein.

Full-size in-line safety straight razor devices of the present invention preferably about 150 mm (about 6 inches) to about 200 mm (about 8 inches) in length. The front cutter support portion is preferably at least about 35 mm (about 1.4 inches) to about 75 mm (about 3 inches) in length, and the handle portion is preferably about 90 mm (about 3.5 inches) to about to 150 mm (6 inches) in length. Larger and smaller front cutter portions and rear handle portions may be used if desired.

These new in-line safety straight razors of the present invention may be utilized in a manner basically similar to that of the unguarded in-line straight razor devices long used by barbers. However, due to the presence of the front and rear guard portions, which help shield the exposed razor-sharp edges so as to minimize the occurrence of minor cuts, nicks and scrapes, the technique is a little different. When in use, for example to shave large areas of skin, such as the face, my full-size safety straight razor devices of the present invention are grasped by the fingers and/or thumb generally around the handle portion. Alternatively, some or all of the fingers may be wrapped along the handle portion, and the thumb placed on or near the side of the front cutter section that is not been currently used for shaving. (Still other styles of gripping the shaving device instrument may also be employed in accordance with the preferences of the individual barber or other user.) The user then places the generally flat face of the operative razor blade structure against the skin so that the elongated front and rear guards thereof contact the skin to be shaved. In this manner, the working plane of the operative blade structure bears against the skin. Then, the razor-sharp edges of the cutter portion bearing against the skin are moved or swept downwardly in a first direction, generally away from the longitudinal axis of the front cutter portion. This first direction is preferably substantially perpendicular to the longitudinal axis of the front cutter portion and to the elongated razor-sharp blade edges. Once the desired area of skin has been shaved once, the shaving stroke may be repeated.

To repeat the stroke, the front cutter portion of the device is either slid rearwardly in a non-shaving motion, or preferably is lifted from the skin, so that the operative razor blade structure is entirely off of the skin, and then moved rearwardly in a second direction directly opposite the first direction. The downward stroke away from the longitudinal axis of the cutter portion is then repeated. Thus, it should be appreciated that the in-line shaving devices of the present invention are unidirectional shaving devices in that each razor blade structure is capable of only cutting in a single direction.

My in-line shaving devices may also be used for the close and accurate shaving of the peripheries of hairlines and facial hair presentations, including the mustaches and goatees, particularly when in the hands of a barber. Miniaturized embodiments of the present invention are particularly useful for close edge work by a user on the front of his face, where he can readily see, through the use of a mirror, the area where he is shaving. The pinch-grip fingertip tab gives the user precise fingertip control over the blade positioning and stroke, and it can even be used successfully beneath the user's nose including the sloped areas of the naso labial fold located between the nose and upper lip. These smaller versions of my in-line safety straight razors are preferably made so small and lightweight that each can be easily gripped by a user between his fingertips for precise cutting and shaving of the peripheral edges of his own mustache, goatee or sideburns.

Thus, the miniaturized versions of the in-line safety straight razors are a third aspect of the present invention. Three such devices are the first three embodiments shown in the accompanying figures. Each can well serve as an in-line safety straight razor mustache shaving device. These miniature straight razor device may each include an elongated, narrow, body or strip, corresponding to a frame, with a rear end or half portion thereof formed as an elongated fingertip-grip portion and the opposite end or front half portion formed as an elongated cutter end or head portion. The fingertip grip portion is quite small and can also be properly considered or called a fingertip pinch grip tab. The lower side of the head or cutter portion is preferably provided with a formed channel or recess within which a narrow metal strip of a razor blade is mounted. The blade has a sharpened edge of razor quality which extends outwardly of the channel so that this edge is exposed along a longitudinal side of the head. My miniaturized in-line safety razor shaving device generally has a flat, elongated blade with a razor sharp edge no longer than about an inch (about 2.5 cm). The fingertip grip portion has an overall size approximately as large as the area between the tips of the user's thumb and forefinger when the tips are pressed together. The overall size of the fingertip pinch grip portion preferably is about as large as the overall size of the cutter end portion. The fingertip pinch grip portion preferably has a major centerline or axis which is offset from the major centerline or axis of the cutter end portion in a direction that places the pinch grip portion further away from the sharp edge of the blade. In addition, since the head portion is located forwardly of the fingertip grip portion, neither the user's fingertips on the device, nor his fingers or hand obstruct his view of the razor blade as he watches himself in the mirror as he shaves his mustache and its periphery with the device. The mustache shaving devices may include single or double razor blade structure configurations, as well as double-sided, double structure configurations for shaving with either side of the forward cutter portion.

Other objects, features, operating principles, and advantages of the razor shaving devices of the present invention will become apparent upon studying the various Figures in the drawings and reading the following detailed description and subjoined claims.

BRIEF DESCRIPTION OF DRAWINGS

In the drawings, various embodiments of the in-line straight razor shaving devices of the present invention are shown. For purposes of illustrating the features and advantages of the present invention, the figures, in the interest of clarity, at times exaggerate somewhat the size, spacing, clearances and/or relative sizes of or between certain parts of my shaving devices. In the various Figures, like reference numerals indicate similar components or features, and the Figures may be briefly described as follows.

FIGS. 1 and 2 show a first embodiment of a double-sided safety straight razor device of the present invention, shown in a miniature size, which includes a one-piece in-line frame with a front cutter portion having a pair of dual-razor blade strip structures or replaceable cartridges mounted in opposing relation, wherein:

FIG. 1 is an assembled perspective view which includes the use of the pair of double-bladed razor blade structures, with essentially only one side being visible; and FIG. 2 is a partially exploded cross-sectional view taken along lines 2—2 of FIG. 1.

FIGS. 3 and 4 show second and third embodiments, respectively, of the double-sided safety straight razor device of the present invention, shown in a mini-size, which each include a one-piece in-line frame with a front portion having a pair of twin-razor blade strip structures mounted in opposing relation, wherein:

FIG. 3 is a perspective view of the second embodiment which includes a pair of single-razor blade strip structures mounted in opposing relation, and FIG. 4 is a perspective view of the third embodiment which includes a pair of double-razor blade strip structures mounted in opposing relation, with a wire guard system wrapped over the razor-sharp edges of each blade strip structure.

FIG. 6 is a side perspective view showing the double-sided cartridge mounted on the in-line frame on a full-size handle, and FIG. 7 is an enlarged cross-sectional view of the double-sided cartridge taken along line 7—7 of FIG. 6, showing the internal construction of the double-sided cartridge, with the two sets of opposed razor blade strips being parallel to one another.

FIG. 8 is a side elevational view,

FIG. 9 is a perspective view from half-way between a side view and a bottom view, showing the handle=s generally circular cross-section, and FIG. 10 is a bottom view.

FIG. 11 is a side elevational view,

FIG. 12 is an upper front/side perspective view showing the partially hollow elongated handle, and FIG. 13 is a bottom view.

DETAILED DESCRIPTION OF THE PREFERRED EMBODIMENTS

The following detailed description of various embodiments of the mini-shaving devices and the larger full-size razor-shaving devices of the present invention are presented by way of example only and are not intended to limit the invention to just those embodiments shown. My miniature size ("mini-") shaving devices are intended primarily for mustache shaving by one's self, but may be used by one's self for any other hair-shaving or hair-cutting purpose for which they are well-suited. My full-size in-line razor shaving devices may be viewed as larger versions of the mini-shaving devices, and are intended primarily for use in shaving larger skin surfaces, such as the face, arms, legs or torso, primarily by barbers shaving others, such as their customers. These larger devices too may be used for any other hair-shaving or hair-cutting purpose for which they are well-suited, by a barber or by an individual user. The description herein of the various embodiments is intended to enable one skilled in the art to make and use the structures of these inventions in many forms. Thus, the overall scope of my invention here should be understood to encompass the adaptations, variations, alternatives and different uses of the devices that are described herein or are logically derived from the teachings herein.

My in-line straight razor shaving devices disclosed herein have structures that are symmetrical about their central longitudinal plane (which in most Figures herein, is a vertically-oriented plane). In most of my shaving devices for example, the overall appearance and structure, including the cutter head portion and handle or pinch grip portion, is symmetrical about this plane, which the razor blade strip also lies in. Unless otherwise indicated or shown to be asymmetrical, then, my devices and accessories (such as covers) should be assumed to be symmetrical about their central plane. Thus, those in the art should appreciate that the descriptions herein of one side, end, or section of any given razor head portion or rear handle or fingertip grip portion will also serve to describe the other half of the generally symmetrical structure on the opposite side of this central plane.

Figure 1:
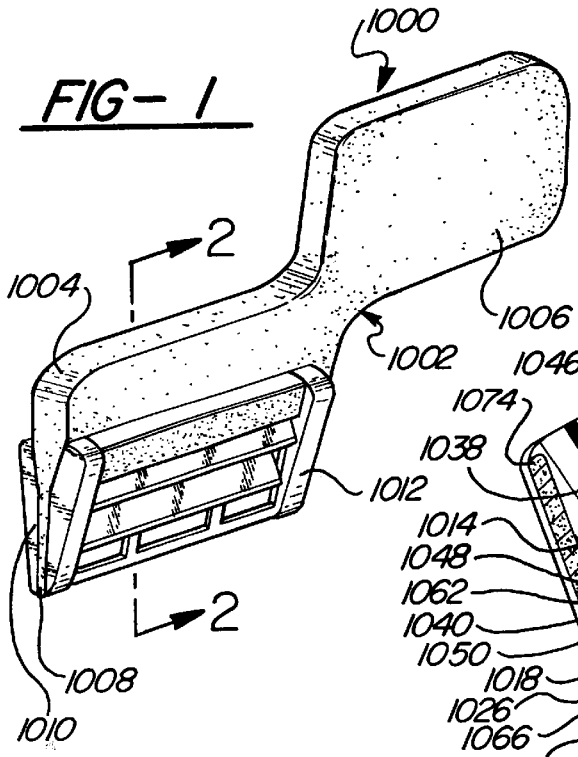
Figure 2:
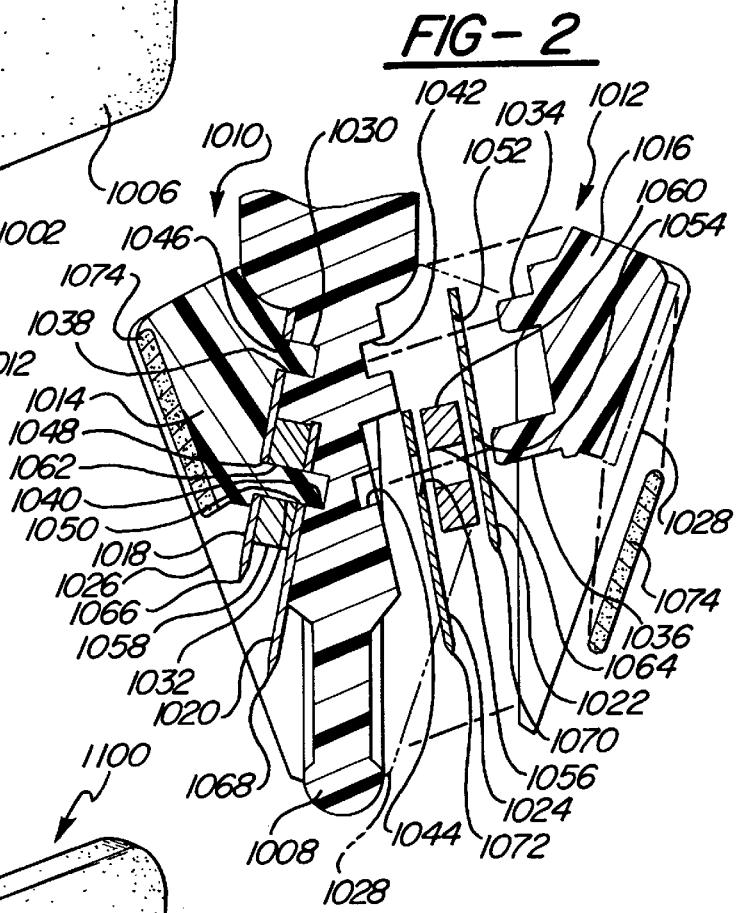

FIGS. 1 and 2 show a first embodiment of the in-line safety razor shaving device 1000 of the present invention, which is of miniature size, in order to serve as mustache shaving device which can be manipulated by finger-tip control. Device 1000 includes an elongated, generally flattened frame or body 1002, which includes cutter head portion 1004 and integral rear fingertip grip portion 1006. (It should be appreciated that virtually all of the integral fingertip grip portions shown among the various embodiments of my U.S. Pat. No. 5,673,711 may be substituted as desired among any of the mini-size embodiments described herein.) In this arrangement of my invention, however, the shaving ability of the device is accomplished through the use of twin dual razor blade strip structures mounted to a centrally located, specially configured front frame portion 1008 of head portion 1004. Frame portion 1008 is configured to accept the engagement of dual razor blade strip structures 1010 and 1012, mounted upon either side, thus producing a two-sided shaving device. It should be appreciated that only one blade cartridge structure may also be mounted upon central frame section 1008 on one side, thereby creating a single-sided shaving device. As will be better understood from the description below, central frame 1008 serves as the common elongated base platform, with appropriate flat surfaces and blade alignment shoulders and pin-receiving sockets, for both of the razor blade structures 1010 and 1012 mounted thereon.

FIG. 2 shows device 1000 from a partially exploded end cross-sectional view, with blade strip structure 1010 shown in an assembled state, and blade strip structure 1012 shown in an exploded state. Structures 1010 and 1012 each include rear guard portions 1014 and 1016. Guard portions 1014 and 1016 are formed as elongated cap members each specially configured on the underside thereof with pins to engage sockets within central frame 1008, and to receive and hold in place the various other components making up razor blade structures 1010 and 1012. Structures 1010 and 1012 are each shown to be double-bladed structures, having two elongated very thin flat metal alloy blade strips 1018 and 1020 or strips 1022 and 1024, which each have an exposed razor-sharp elongated edge. The blade strips of each structure are disposed in distinct blade planes spaced from and parallel to one another and located at acute angle less than about 45 degrees, and preferably in the range from about 10 degrees to about 35 degrees, relative to the working plane defined by the elongated front and rear guards, as will be explained. In other words, the blade planes are slightly tilted outwardly and downwardly relative to the central longitudinal plane of device 1200 in which the longitudinal axes of front cutter portion 1203 and handle portion 1206 lie. This angle of outward tilt is preferably in the range of about 5 degrees to about 25 degrees, and may be about 15 degrees at shown. Accordingly, the blade planes between razor blade structures

1010 and 1012 are tilted relative to one another by twice that amount, assuming that razor head structures 1010 and 1012 are symmetrically arranged as shown about the central longitudinal plane of device 1200. As shown, the blade planes of the lower blades 1020 and 1024 thus intersect at a first imaginary line of intersection spaced from the blunt longitudinal edges of blades 1020 and 1024 opposite their respective blade edges 1068 and 1072. This imaginary line of intersection is parallel to and from the razor-sharp edges of the respective razor blades, and preferably is parallel to the longitudinal axis of cutter head support portion 1204. Also, the blade planes of the upper blades 1018 and 1022 intersect at a second imaginary line of intersection spaced from the blunt longitudinal edges of blades 1018 and 1022 opposite their respective sharpened blade edges 1066 and 1070. This is second imaginary line of intersection is also parallel to and opposite from the razor-sharp edges of the respective razor blades, is parallel to the first imaginary line of intersection and preferably also is parallel to the longitudinal axis of cutter head support portion 1204.

Cap members 1014 and 1016 also include, as integral end extensions thereof, side guard portions, such as portions 1025, 1026, 1027 and 1028. These form side guards which shield the sharpened blade corners from the skin to be shaved. Side members 1025 through 1028 also provide a further function relative to blade strips 1018, 1020, 1022 and 1024, in that they help in part define the working planes for the razor blade strips, and make it more difficult for a user to accidentally dig the razor-sharp edge of the blades into the skin to be shaved.

Blade strip structures 1010 and 1012 can be made as removable cartridges if desired. Structures 1010 and 1012 are preferably engaged with central frame section 1008 by any suitable fastening means, including but not limited to integrally formed pins 1030 and 1032 or pins 1034 and 1036, which are receivable within sockets 1038 and 1040 or sockets 1042 and 1044 in central section 1008. Pins 1030, 1032, 1034 and 1036, pass through apertures 1046, 1048, 1050, 1052, 1054, and 1056 formed within blades 1018, 1020, 1022 and 1024 for retaining these blade strips in place. As can be seen in FIG. 2, in this particular arrangement, upper blade strips 1018 and 1022 each include two such apertures while the lower blades 1020 and 1024 each include only a single aperture. Spacers 1058 and 1060, which may be made of any suitable material, such as mica or plastic, are also provided to separate the upper (rear) and lower (front) blade strips within each blade strip structure by a specified, predetermined suitable distance, such as the distances used in conventional twin-blade cartridges on modern T-bar razors which have similar staggered front and rear blade strips. Spacers 1058 and 1060 include apertures 1062 and 1064 for accommodating the insertion of pins 1032 and 1036. In this arrangement, it can be seen that the lowermost pins 1032 and 1036 are operable for securing upper blades 1018 and 1022, spacers 1058 and 1060, and lower blades 1020 and 1024. Two or more sets of such pins may be provided at spaced intervals longitudinally along central section 1008 as necessary to adequately secure structures 1010 and 1012 to this frame section.

When the components of blade cartridge structures 1010 and 1012 are in an assembled form, such as at the lefthand portion of FIG. 2, razor-sharp blade edges 1066, 1068, 1070 and 1072 of blade strips 1018, 1020, 1022 and 1024 are positioned such that they just barely project into their respective working planes established by the elongated front and rear guard members of structures 1010 and 1012. Structures 1010 and 1012 each have an exposed face configured in a substantially planar arrangement, so that it can be laid flat against the skin to be shaved. The working planes are established by the left and right sides of the elongated rounded lower portion of central extension 1008, which elongated smooth surfaces serve as the front guards for structures 1010 and 1012, and by the exposed surfaces of elongated flat thin rectangular lubricant strips 1074 and 1076 that are bonded to guard portions 1014 and 1016, and which define the rear guard surfaces. As shown in both FIGS. 1 and 2, in each razor blade structure 1010 or 1012, the elongated straight razor blade edges are spaced from one another and from the front and rear guards, and are arranged to be parallel to one another and the front and rear guards.

Figure 3:
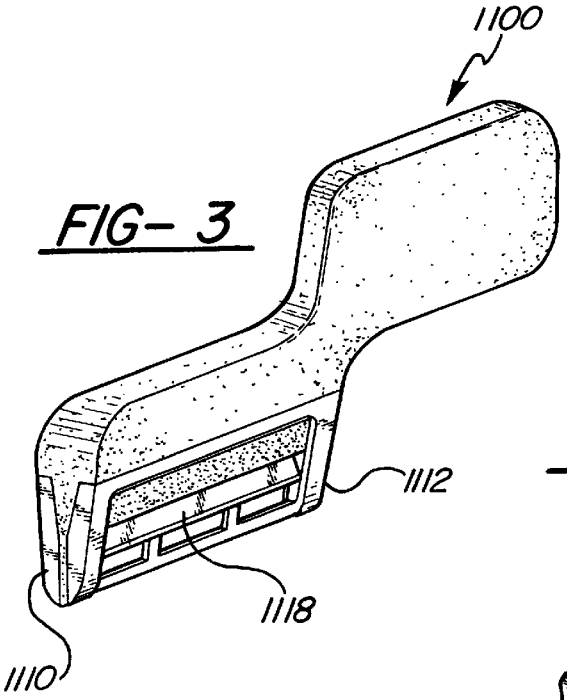

FIG. 3 shows a second embodiment of in-line safety razor shaving device 1100, which is also of mini-size for mustache shaping and trimming. Device 1100 is substantially similar in overall construction to the FIG. 1 embodiment. Device 1100 includes oppositely disposed blade strip structures 1110 and 1112 that are each of a single-blade strip design. As shown in FIG. 3, a single blade 1118 is visible in blade structure 1112, which may be constructed as a removable, replaceable cartridge if desired.

Figure 4:
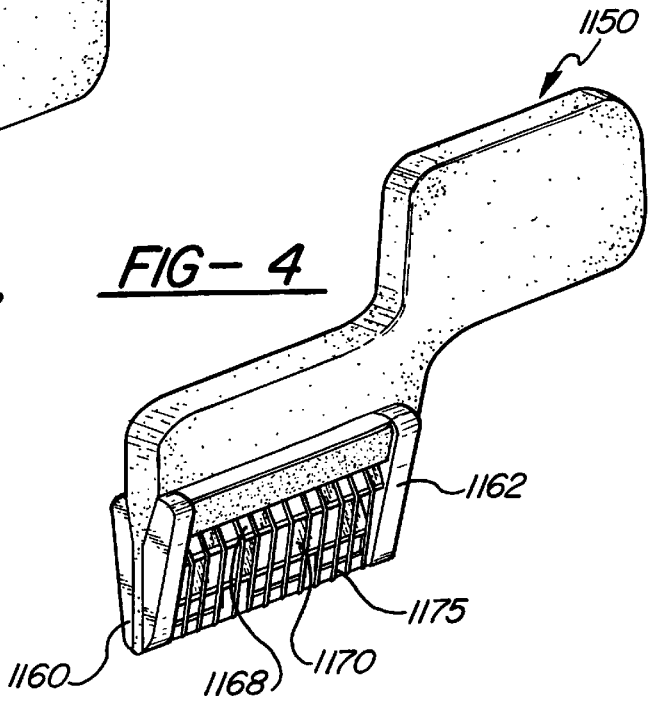

FIG. 4 shows a third embodiment of a mini-size in-line shaving device 1150 of the present invention, useful as a mustache shaping and trimming device. Device 1150 is substantially similar in overall configuration to the previous two embodiments. Its blade structures 1160 and 1162 are again in an oppositely disposed relation, and this time are each a double-bladed structure, as in FIGS. 1 and 2. Accordingly, blade strips 1168 and 1170 are visible as part of blade cartridge structure 1162. As an additional feature, device 1150 includes wire guard means 1175, which preferably may be a series of turns of a thin metallic wire wrapped at spaced intervals about blade cartridge structures 1160 and 1162, across and perpendicular to the exposed razor-sharp blade edges. This wire guard structure 1175 provides an additional means for safely guarding the sharpened exposed edges of the blade strips, such as strips 1168 and 1170, against accidentally cutting into the skin during shaving, while still permitting hair stubble to be closely shaved from the face or other skin being shaved.

Figure 5:
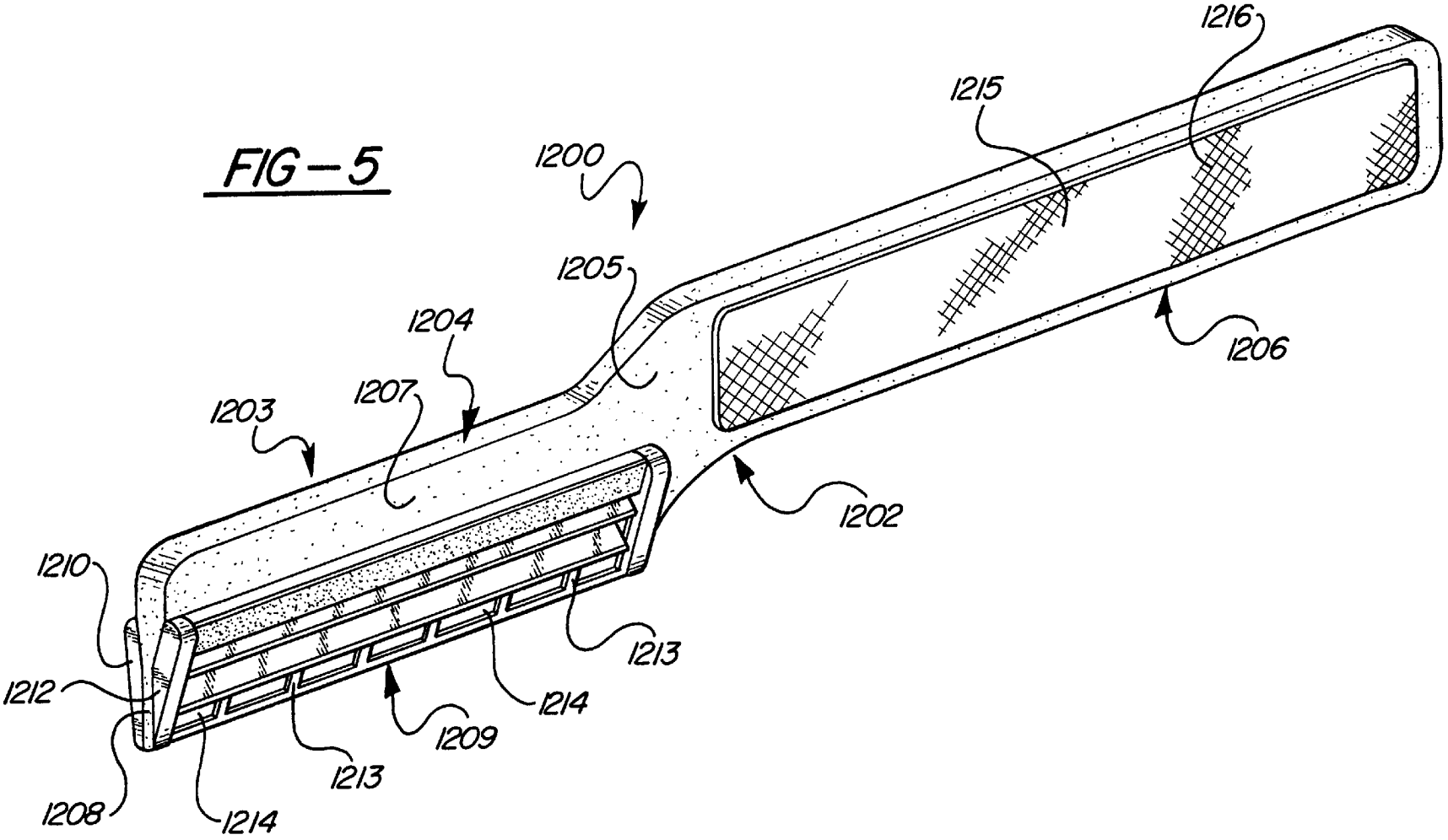
FIG. 5 show of a fourth embodiment of a double-sided safety straight razor device of the present invention, in a side perspective view, which is a full-size device constructed similarly to the FIG. 1 embodiment, but with a longer front portion having substantially longer razor blade strips and a longer rear handle grip portion, and an intermediate angled transition region forming the front part of the handle portion.

FIG. 5 shows a fourth embodiment of the in-line shaving device of the present invention, generally at 1200, which is a full size in-line double-sided manual safety straight razor device. Device 1200 is capable of efficiently shaving larger skin surface areas of the face or other areas of the body than the previously-described versions. Device 1200 includes an elongated frame 1202 of generally rectangular cross-section. Device 1200 includes cutter head portion 1203 supported by elongated cutter head support portion 1204 of frame 1202. Frame 1202 also includes a generally curved or diagonal transition region 1205 and elongated rear handle portion 1206. Portions 1204 through 1206 are all permanently attached to one another in this embodiment. Transition region 1205 may be considered the front part of handle portion 1206. Preferably, at least part of cutter head support portion 1204 and handle portion 1206 (including transition region 1205) are integrally formed of the same material, such as plastic, metal or other suitable material, which may be partially hollow, or be provided with recesses more apertures therein, to save material and weight, if desired. Cutter head portion 1203 and rear handle 1206 have their respective longitudinal axes located in the same common major plane (which plane is vertical in FIGS. 6 and 7), but offset from one another as in the first three embodiments. Alternatively, the longitudinal axes of portions 1203 and 1206 may arranged in line with one another. As another alternative, transition region 1205 may have a lazy S shape so that the longitudinal axis of handle portion 1206 is offset in two directions from the longitudinal axis of cutter portion 1204. In other words, in this version of device 1200, the longitudinal axis of handle portion 1206 may be elevated above and laterally spaced from the longitudinal axis of cutter portion 1204. In this regard, frame 202 would resemble the compound offset frame shown in FIGS. 30A through 30D of my U.S. Pat. No. 5,673,711.

The overall length of device 1200 preferably is in the range from about 125 mm (about five inches) to about 200 mm (about 8 inches), with preferred lengths being in the range of length of about 150 mm (about six inches) to about 180 mm (about seven inches). The thickness of frame 1202 may be adjusted as desired, with an average thickness in the range of 4 mm (about 5/32 inch) to about 12 mm (about ½ inch) being preferred. The average height of frame 1202 preferably ranges from about 10 mm (about 0.4 inch) to about 25 mm (about 1 inch) but may be taller or shorter if desired.

Preferably, rear handle portion 1206 is at least about 100 mm (about four inches) to about 150 mm (about six inches) long or longer. With such a length, handle 1206 can be gripped by fingers and thumb of the hand of an average size adult user in just about any way desired. For example, the side of the user's thumb opposite its fingernail may be rest upon transition region 1205 or even a rear part of cutter portion 1204. Or, any other convenient handgrip may be utilized. In any event, the size of rear handle portion 1206 is preferably sufficiently large and long so that device 1200 can be manipulated using the full hand and wrist instead of by the fingertips, as in the previous embodiments. Grip-enhancing pads, like flat generally rectangular rubber pad 1215, may be bonded to or otherwise suitably provided on both flat planar opposed sides of handle 1206, if desired. The pads or handle itself can also be provided with a textured surface, as represented by cross-hatching 1216. Note that overall flat stick-like shape and the rectangular cross-section of handle 1206, particularly its opposed flat side surfaces 1215, serve as means for providing tactile feedback to the user through his hand as to the precise orientation of cutting head 1204, since it is rigidly connected to handle 1206 and moves therewith.

Cutter head support portion 1204 includes an elongated thicker upper section 1207 and an elongated thinner frame section 1208 downwardly depending from section 1207. Upper section 1207 functions as the backbone of front support portion 1204, helping to give portion 1204 sufficient stiffness to avoid any appreciable flexing between front portion 1204 and rear handle 1206 as device 1200 is used for shaving. Backbone section 1207 tapers into planar frame section 1208, whose lower half-section 1209 features an elongated continuous lower member 1211 supported by regularly spaced vertically-extending support pillar members 1213, which together define rectangular through-holes 1214 therebetween.

Upon cutter head support portion 1204 is mounted a pair of opposing elongated razor blade strip structures 1210 and 1212. The opposing nature of razor blade structures 1210 and 1212 allows device 1200 to be used in opposite directions and in either a right-handed or left-handed manner. Accordingly, both sides of cutter head 1203 may be used for shaving, but only one of razor blade structures 1210 and 1211 may be in use at any one time.

Any suitable razor head connection mechanism (not shown) may be utilized for receiving and supporting the razor blade strip structures on frame portion 1204. Structures 1210 and 1212 shown in this embodiment are dual razor blade strip structures, in that each structure includes two spaced apart generally parallel elongated razor blades, each having a razor sharp edge arranged along a straight line which is distinct from the straight line representing the edge of any other blade. Each razor blade in this structure, as well as in other embodiments described herein, preferably includes an exposed razor-sharp edge at least about 35 mm (about 1.4 inches) long, and may be about 50 mm (about two inches) long or longer if desired. (A single elongated razor blade arrangement may alternately be used for each structure, if desired.) Preferably, razor blade structures 1210 and 1212 are essentially mirror images of one another on opposite sides of lower frame section 1208, such that they are fully symmetrical about a transverse center plane, and are thus interchangeable with each other. If desired, razor blade structures 1210 and 1212 may be made substantially like conventional assembled single or multiple blade razor blade strip head structures of the type in common use today on the elongated bases or platforms of T-bars. Structures 1210 and 1212 may be made as replaceable razor blade cartridges, so that they can be both removed and replaced whenever they are dull or a fresh unused razor blade cartridge is desired. For example, a barber may change cartridges with each new customer to be shaved. The specific design of the razor blade structure will now be described in greater detail below.

Cutter head 1203 of device 1200 shares a few components or features in common between the two opposing razor blade structures 1210 and 1212, including the common lower bar section 1209 and the plurality of through-hole apertures 1214. These holes provide a path for cut hair stubble and other shaving debris to be deflected and passed through cutter head frame 1207 of support portion 1204. Seven such apertures are shown in device of FIG. 5, four more than the three such apertures shown in the device of FIGS. 1–4. Another benefit of these apertures is that they allow the user to look through them to have a better view of the razor-sharp edge of the first or lower razor blade strip on the razor head structure presently being used for shaving. This substantially open view allows closer viewing and more accurate positioning for precise shaving of the peripheries of facial hair features such as goatees and sideburns. In this regard, it should be appreciated that many of the design features, sizes and configurations from this embodiment may be carried over and adapted, albeit with modifications among the various embodiments.

Figure 6:
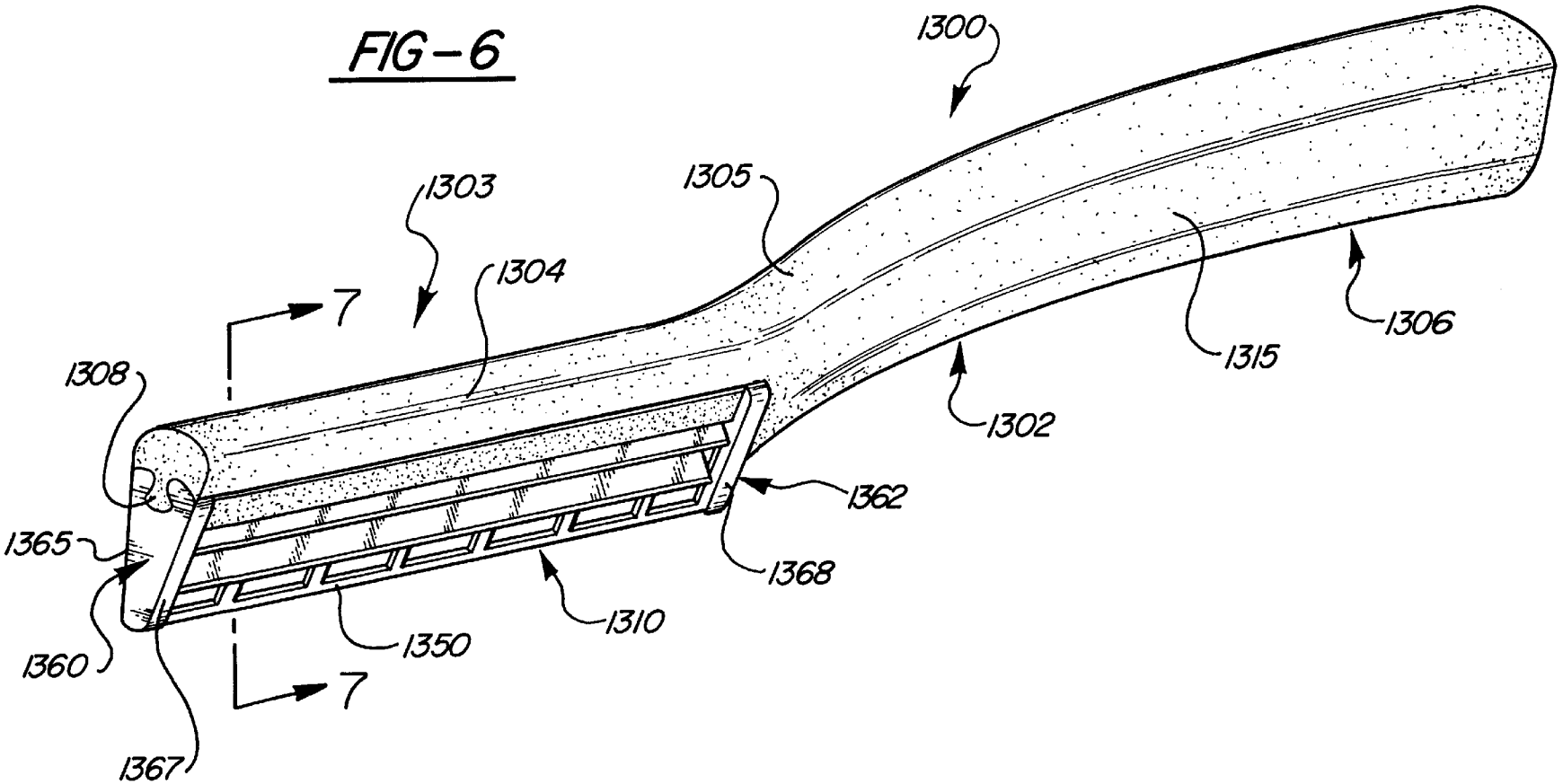
FIGS. 6 and 7 illustrate a fifth embodiment of a double-sided safety straight razor device of the present invention, shown in full-size, with a front razor head portion being a removable cartridge containing a double-sided safety straight razor head, placed upon a straight-mounting channel-type frame extending in-line with the central longitudinal axis of the elongated handle, where.
Figure 7:
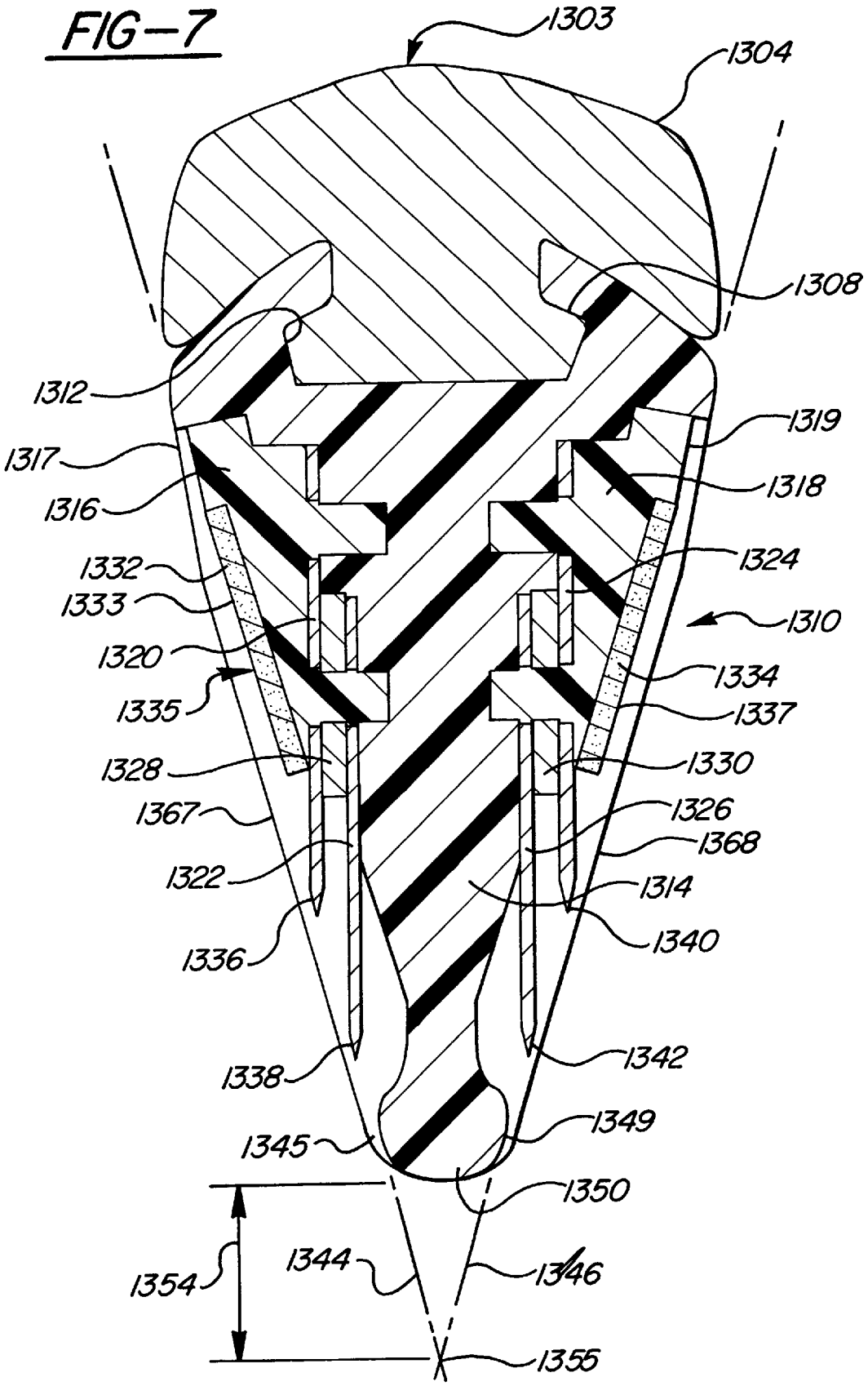

FIGS. 6 and 7 show a fifth embodiment of a full-size double-sided safety straight razor device 1300. FIG. 6 shows that device 1300 includes a frame 1302 of a more rounded cross-section. Device 1300 includes cutter head portion 1303 built about centrally-located elongated front support portion 1304 and elongated rear handle portion 1306, that together form frame 1302. Rear handle portion 1306 has a generally oblong cross-section formed by rounded upper and lower surfaces, and generally flattened opposed sides. The oblong cross-section provides a different gripping surface for the full hand than the thin flattened rectangular cross-section of FIG. 5 handle, which some users may prefer. Additionally, the generally oval shape of handle 1306, and especially the flattened diametrically opposed side surfaces 1315, serve as means for providing tactile feedback to the user through his hand as to the precise orientation of cutting head 1303, since it is rigidly connected to handle 1306 and moves therewith.

Cutter head support portion 1304 includes on its lower side, an elongated engagement rail 1308, in the form of an elongated tenon, which mechanically interlocks by snugly sliding into an elongated complementary socket 1312, in the form an elongated mortise, provided on the upper end of a combined double-sided dual razor blade strip structure 1310, that takes the place of razor blade structures 1210 and 1212 in the FIG. 5 embodiment. In this arrangement, elongated razor structure 1310 is of a unitary double-sided design, so that only the single combined double-sided cartridge need be removed and replaced. Any other suitable means for mechanically interlocking cartridge structures 1310 to cutter head support portion 1304 may be utilized. Alternatively, cutter head portion 1304, handle portion 1306 and centrally-located combined platform portion of the combined double-sided razor blade strip structure, such as that shown at 1310, may be integrally formed of the same material, such as a molded plastic material, if desired.

FIG. 7 is an enlarged cross-sectional view of cutter head portion 1303 of device 1300 taken through lines 7—7 of FIG. 6. This enlarged view shows in greater detail a preferred construction for razor structure 1310. It will be appreciated that the features shown herein may be used to in other embodiments described herein. Razor structure 1310 includes an elongated generally planar central frame 1314 that serves as a common platform structure for the two sets of razor blade strips mounted in opposed relation on opposite sides thereof. Platform structure 1314 cooperates with cap members 1316 and 1318, those generally flat elongated outer surfaces serve as rear guards, to secure razor blade strips 1320, 1322, 1324 and 1326 within the device. Rear guard portions 1316 and 1318 are typically at least about 25 mm (about one inch) long, and preferably are 38 mm (about 1.5 inches) to about 50 mm (about two inches) long, or longer. As noted before, the razor blade strips are typically thin, flat, elongated and rectangular, and made from a metal alloy material. They typically have a thickness less than 0.12 mm (about 0.005 in.) and preferably less than or equal to 0.1 mm (0.4 mm). The width of the blade strips may be any suitable size, such as in the range of about 2 mm to about 6 mm, with blade strips widths less than or equal to about 4 mm being preferred. As before, the sets of front and rear blade strips 1338, 1336 and 1342, 1340 are preferably arranged in offset or staggered relation, as shown, separated into parallel blade planes by spacers 1328 and 1330, which may be formed from elongated flat strips of plastic or mica, as shown. As best shown in FIG. 7, the sets of blade strips 1336, 1338 and 1340, 1342 are disposed in essentially parallel relation, relative to each other, which may help simplify construction and/or assembly. Further, it enables central frame section 1314 to have a thicker stronger cross-section or width than central frame section 1208 which implements the outwardly tilted blade arrangement in the FIG. 5 embodiment.

As shown in FIG. 7, exposed surfaces 1317 and 1333 of cap member 1316 and its lubricant strip 1332 constitute the rear guard surface 1335 for razor blade strips 1336 and 1338 on the left half of FIG. 7. Flattened exposed surface portion 1345 of rounded elongated lower member 1350 constitutes the front guard surface for blade strips 1336 and 1338. Together these exposed front and rear guard surfaces 1335 and 1345 define working plane 1344 for blade strips 1336 and 1338. Similarly, exposed surfaces 1319 and 1337 of cap member 1318 and its lubricant strip 1334 constitute the rear guard surface 1339 for razor blade strips 1340 and 1342 on the right half of FIG. 7. Flattened exposed surface portion 1349 of rounded elongated lower member 1350 constitutes the front guard surface for blade strips 1340 and 1342. Together these exposed front and rear guard surfaces 1339 and 1349 define working plane 1346 for blade strips 1340 and 1342. As shown in FIG. 7, working planes 1344 and 1346 are shown angled toward to one another at an acute angle about 35 degrees. This angle may be any suitable angle, preferably in a range from about 0 degrees to about 90 degrees, with angles in the range of about 20 degrees to about 50 degrees being preferred. Preferably, the thickness of lower member 1350 and the acute angle between the working planes 1344 and 1346 are such that the imaginary line of intersection, represented by point 1355 at the bottom of FIG. 7, is spaced from and is below member 1350 by distance 1354, which distance is preferably at least 2 mm to about 6 mm. Preferably, this imaginary line 1355 of intersection is generally parallel to the longitudinal axis of cutter head portion 1303, by virtue of the opposing sets of razor blades being essentially mirror images of one another.

As shown in FIGS. 6 and 7, central support section 1314 preferably includes wedge-shaped end extension sections 1060 and 1062 at opposite ends thereof. The outward generally flat exposed surfaces of end wedges 1360 and 1362 form side guard portions 1365, 1366, 1367 and 1368. These side guards shield the skin to be shaved from the sharp blade edge corners. Side members 1365 through 1368 also provide a further function relative to blade strips 1336, 1338, 1340 and 1342, in that they help in part define the working planes for the razor blade strips, and make it more difficult for a user to accidentally dig the razor-sharp edge of the blades into the skin to be shaved. End extension wedge sections 1360 and 1362 are preferably integrally formed as part of central section 1314 using the same material, such as is readily accomplished in the plastic molding process that may be used to form part 1314. The overall length of central frame 1314 is typically slightly longer than the blade strips lengths, and the rounded distal surface upon which rounded semi-flattened surface portions 1345 and 1349 are formed is preferably about the same length as the razor blade strips.

Figure 8:
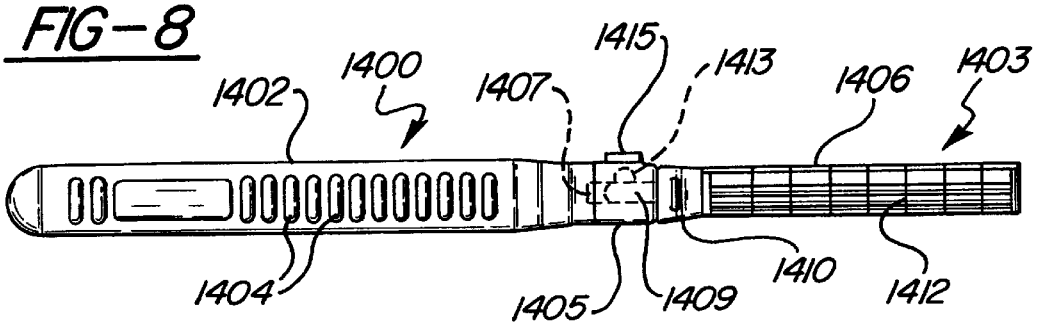
FIGS. 8 through 10 illustrate a sixth embodiment of a double-sided safety straight razor device of the present invention, having a removable cartridge razor head with wire-wrapped blade strips extending in-line from the central longitudinal axis of the elongated handle, where.
Figure 9:
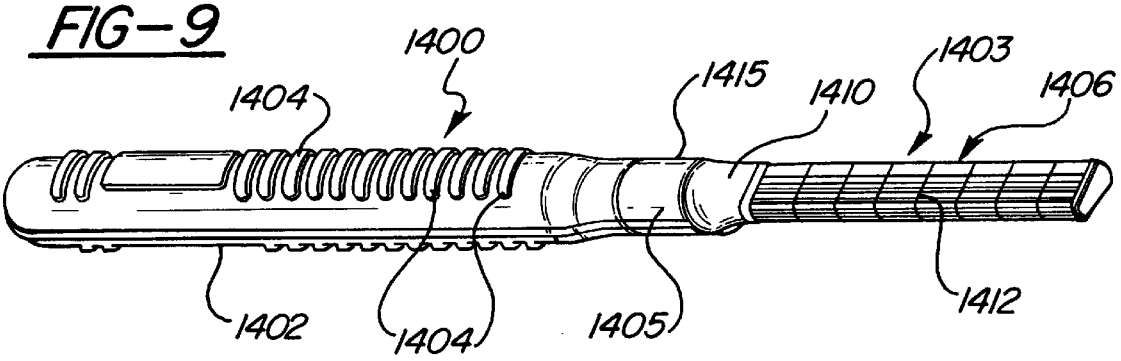
Figure 10:
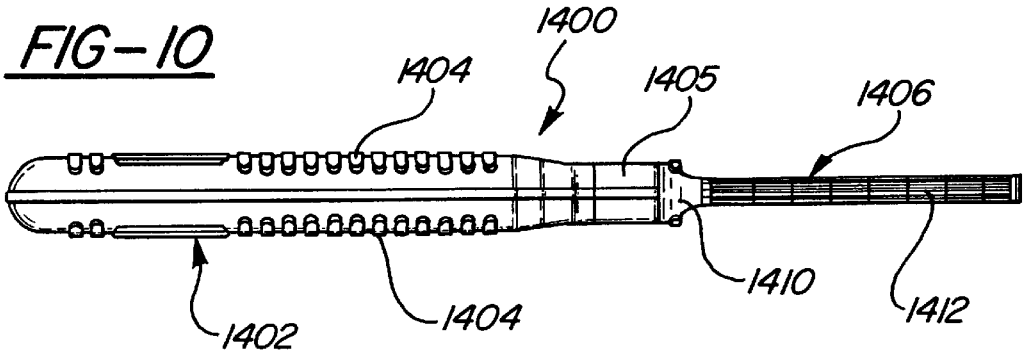

FIGS. 8, 9 and 10 show a sixth embodiment of double-sided safety straight razor device 1400, from a side elevational view, a perspective side view generally revealing one side and bottom of the instrument, and a full bottom view, respectively. Device 1400 includes elongated generally cylindrical rear handle portion 1402 and a front cutter portion 1403 consisting of a removable double-sided dual razor blade strip structure 1406 that is attached to, and extends in a generally directly in-line from, handle 1402. The cross-section diameter of handle 402 is preferably in the range from about 7 mm to about 25 mm, with diameters in the range of 10 mm to about 20 mm being preferred, and in the range of 10 mm to about 15 mm the most preferred. Handle portion 1402 preferably has several gripping surfaces 1404 raised about one to two millimeters above the general outer diameter of handle portion 1402 for facilitating easy secure holding of handle 1402. This is desirable, particularly when the hand and handle are wet or soapy or otherwise tend to be slippery for any reason. Gripping surfaces 1404 may be of any suitable configuration, and may be of any suitable material, such as metal, plastic or an elastomeric material. They may form part of a unitary handle structure or they may be separately added to handle 1402, such as by an elastomeric or synthetic soft rubber pad being glued onto the handle, or, as shown as an insert which projects through corresponding holes formed in a generally hollow cylindrical rear handle portion, which is assembled in two elongated semi-cylindrical shells or pieces about the insert. As shown, the gripping surfaces 1404 may be radially arranged segments a few millimeters wide and about 4 mm to 10 mm tall and spaced from one another by a few millimeters. Two lines of such segments are preferably provided on both sides of the cylindrical handle in opposed relationship, as can be seen in FIG. 9.

In device 1400, razor structure 1406 is preferably removably attached to handle 1402 by any conventional or suitable arrangement for interlockingly and yet removably coupling together two generally cylindrical objects of about the same size. Suitable arrangements include axially in-line cylindrical post and bore coupling members, with bore 1407 being centrally located within front end section 1405 of handle 1402 and the post 1409 being centrally located in rear end section 1410 of cutter portion 1406. Alternatively, the post may be placed on the rear end section 1410 of cutter portion 1406 and the cylindrical bore on the front end section 1405 of handle 1402. If desired, a detent mechanism, such as a conventional spring-loaded detent with ball-bearing 1413 operated by an external finger actuator 1415 may be provided to interlockingly engage the front section 1405 of handle 1402 with rear section 1410 of cutter portion 1403. Pressing actuator 1415 releases ball 1413 from a notch within post 1409, allowing post 1409 to be withdrawn from bore 1407, thus decoupling cutter head 1403 from handle 1402. Other suitable interlocking releasable attachment means for removably coupling handle 1402 and cutter head 1403 may be used, including but not limited to threaded male and female coupling members, and bayonet-style, twist-and-lock male and female coupling members.

Razor structure 1406 may be made in accordance with any of the same designs previously described. The end extension section of its central frame portion simply need be extended rearwardly as necessary to accommodate and rigidly connect to rear coupling section 1410. Front cutter portion 1403 further includes wire wrapped blade edge guarding system 1412, which features a series of exposed substantially parallel thin wire segments spaced from one another that drape snugly across the razor-sharp blade edges of the razor blade strips and tautly extend between the front and rear guard members which define the working plane for those blade strips. The exposed segments of wire wrapping 1412 are spaced sufficiently closely that it makes it more difficult for a portion of the skin to be shaved to be caught below the razor-sharp blade edges. Yet, enough space is provided between the wire segments that hair stubble can easily pass therebetween, and be shaved off. Accordingly, wire wrapping 1412 helps reduce the chances of cuts, scrapes or nicks from direct contact of the razor blade edge with the skin.

Figure 11:
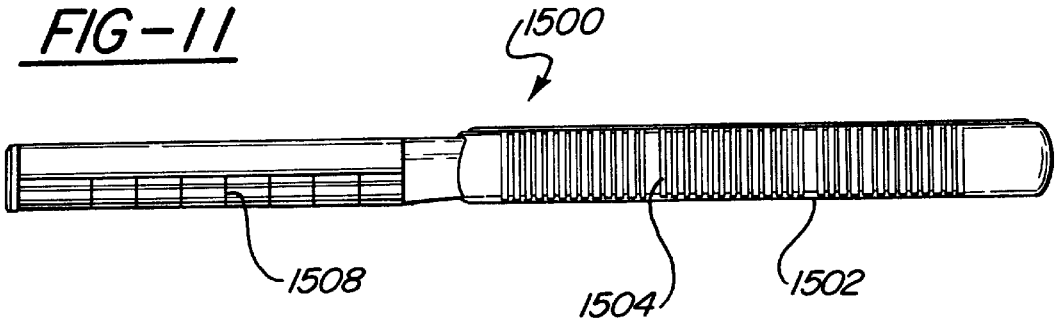
FIGS. 11 through 13 illustrate a seventh embodiment of the double-sided safety straight razor device of the present invention having a single razor blade strip on each side, where.
Figure 12:
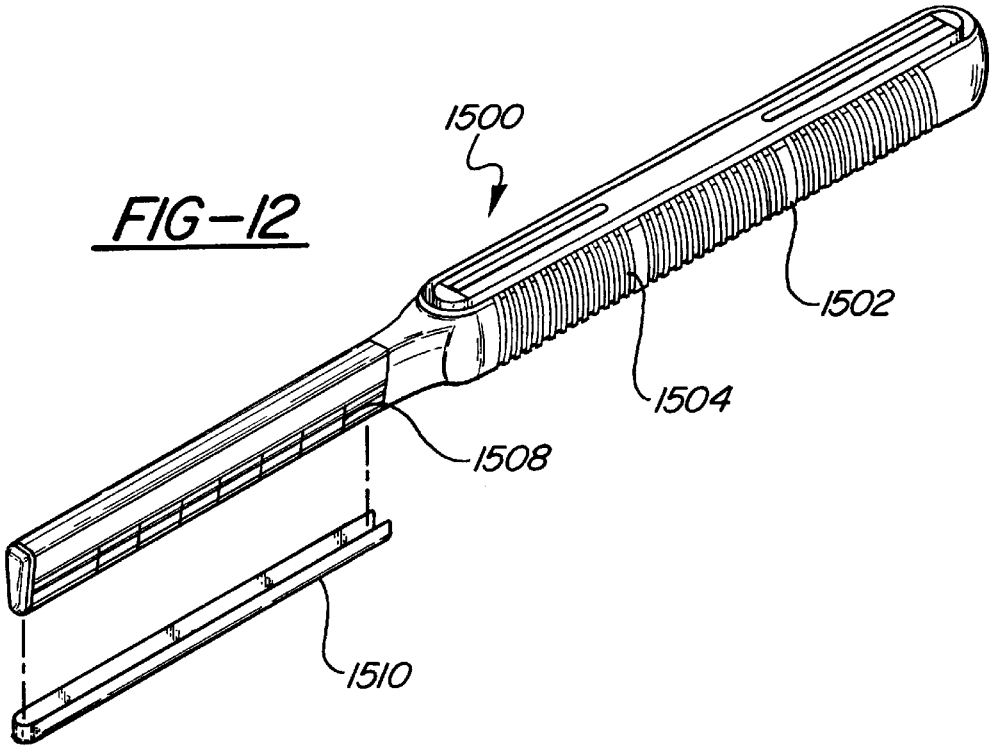
Figure 13:
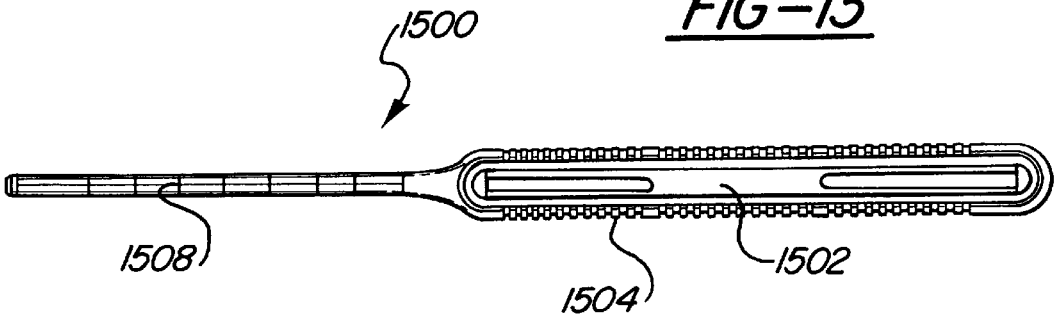

FIGS. 11, 12 and 13 show a seventh embodiment of double-sided safety straight razor device 1500 of the present invention, from a side elevational view, an upper perspective view and a bottom view, respectively. Device 1500, for reasons which will be explained, is generally constructed inexpensively so it can be used as a disposable in-line safety straight razor. Device 1500 includes rear handle portion 1502 directly connected to a front cutter portion 1503 which includes two elongated opposed razor blade structures each having a single elongated blade razor blade strip. Handle portion 1502 has a generally-rectangular, slightly-rounded transverse cross-section, and is preferably made from thin molded plastic material, and also may be a generally hollow elongated dish-like shell as shown. This generally hollow construction may take the form of any conventional or light-weight plastic handle, including those semi-hollow handles found on inexpensive disposable commercially available T-bar razors made by Gillette, Inc., American Safety Razor Co. and others. Handle 1502 is provided with yet another type of specially-contoured gripping surfaces 1504 for facilitating gripping of handle 1502, such as when wet. As shown, these gripping surfaces take the form of a corrugated surface formed from raised vertical ridges in between vertical troughs spaced at regular intervals, such as to 2 millimeters to 4 mm between the centerlines of adjacent ridges. Handle 1502 includes generally rounded sides and generally flattened upper and lower edges, and is partially hollow, as best seen in FIGS. 12 and 13. As before, a double-sided dual razor blade strip structure 1506 is attached to, and extends in a generally in-line configuration from handle 1502, since the longitudinal axes of handle 1502 and cutter head 1503 are generally arranged along common line. Again, razor structure 1506 includes wire wrapped guard 1508. A removable cover 1510 of generally U-shaped transverse cross-section is also provided for covering razor structure 1506 during storage. Guard 1510 and may be made from any suitable material such as molded transparent thin-sheet plastic such as low-density polyethylene or polystyrene or from sheet metal. Preferably, the sidewalls of guard 1510 are sufficiently high to cover the exposed razor blade edges of razor structure 1506, so that cutter portion 1503 may be safely handled and stored.

Device 1500 may be made as a disposable model with a single integrally molded plastic frame forming both the substantially rigid handle 1502 and front centrally-located cutter support section upon which the razor blade strips are mounted in opposed relation. Alternatively, this same inexpensive model may be made with a disposable cutter section 1503 which is releasably attached at the rear section thereof to the front section of the handle by any suitable in-line connection mechanism, including those previously described with respect to the previous embodiment.

Speaking generally now about all of the embodiments, the shaving and trimming of one's own face, mustache, goatee or sideburns is often done while the skin and hands are wet. Thus, the various embodiments of my invention preferably may include one or more means to enhance the user's grip on the handle portion or fingertip pinch grip tab. For example, the handle portion or pinch grip tab may be provided with raised ridges, bumps or knurling, or the opposed surfaces of the handle portion or fingertip grip portion may themselves be shaped so as to provide added gripping security for the user. This may be done by using dished out portions or valleys on the handle or fingertip grip portion to provide a comfortable seat for the finger and thumb as the device is manipulated adjacent to or against the skin of the user's face.

Most, if not all, of my razor shaving devices, especially those that are assembled from preformed plastic pieces with separate blade strips, can be efficiently constructed and economically mass produced using technology and automated assembly techniques similar to that employed in current manual safety razor constructions. In particular, all molded plastic components for my razor shaving devices can be made from conventional plastic materials using readily available molding machinery with dies that have been machined to produce finished parts, such as, for example, the integral fingertip grip and cutter head. The metal blade strips may be made with or without registration holes for receiving locating pins or protrusions in the cutter end of the head. Such metal blade strips can be sharpened along one edge and then cut to length using conventional equipment. Special fixtures and locator tooling can easily be made to allow the custom components of my razor shaving devices to be automatically assembled at a very low cost. Thus, engineers in the safety razor field and users of wet shaving razor systems will recognize my razor shaving device designs and accessories can be readily manufactured by using selected various manufacturing techniques already known as part of the predominant wet shave razor blade system manufacturing technology in use today.

Accordingly, my shaving devices are sufficiently inexpensive in construction that they may be readily discarded and replaced after a limited number of uses. However, the present invention in the broader sense is also intended to cover various designs for a detachable, replaceable blade structure and a detachable, replaceable handle. This allows the shaving device body to be used over and over, thereby further making this embodiment of the device even more inexpensive to use. Because my razor shaving devices are sufficiently compact and versatile, they should prove to be a useful addition to the shaving or toiletry ensemble of many who prefer wet shaving to electric razors.

Epilogue. The term "razor-sharp blade" or razor blade strip" as used herein, including in the claims, encompasses any elongated blade of appropriate size having a suitably sharpened edge, no matter how constructed. Thus, this term covers blade strips made of a single piece of metal or other sharpened or sharpenable material. It also covers razor blade strips made by bonding a thin gauge strip of metal to a more rigid piece of metal, by laser spot welding or any other technique.

Those skilled in the field will appreciate that the foregoing illustrated and discussed embodiments of the shaving devices of the present invention are subject to modification and change without departing from the scope of the invention as recited in the claims below. Needless to say, the overall size, proportion, materials, weight and clearances of the various components used as part of the frame, front cutter support portion or rear handle portion, and connection mechanisms for attaching the razor blade structures to the front support portion of the shaving devices of the present invention can be varied as needed or desired. A number of other possible modifications have already been described above. Further changes are clearly possible, as will now be discussed first in the following examples.

(1) Different features and aspects of one embodiment may be combined with another embodiment to provide a shaving device or system with the desired features from both. (2) The lubricant strip used in the above descriptions in the earlier embodiments may also be built into the later embodiments, and may also be made part of the razor head structure through impregnation or molding, rather than being a separate strip glued onto the razor's cap or rear guard member. In other words, a solid shaving aid strip may be provided as an integral portion of the cap or other structural member in any form that is substantially immovable. (3) A smoothly finished glide strip or surface which does not dissolve with use may be used in place of a dissolving lubricant strip material. The front and rear guard surfaces can be made of the same plastic material as the rest of the head, but provided with a very smooth micro-finish. Alternatively any suitably smooth or slippery material may be used as the rear guard by being integrally molded, bonded or mechanically fastened to the blade-supporting structure of the shaving device. The elongated front and rear guards may be made of polytetrafluoroethylene (PTFE), or of molded plastic, or may be coated, using vapor deposition techniques or other suitable methods, so as to form a smooth, slippery, relatively wear-resistant and substantially inert layer. (4) Any type of conventional or suitable pin or post arrangement, beyond those already disclosed herein, may be utilized to retain the elongated blade strip within the shaving structures of the present invention. (5) Most of my shaving devices disclosed above may be constructed with a detachable, replaceable cartridge-style razor blade-supporting portion, so that handle portion may be re-used multiple times. (6) The blade strip within a number of my assembled shaving devices of the present may be made to be individually movable and spring-loaded within the channel in the head or cutter end portion by spring-loading them in a suitable manner, such as those found in current Gillette Sensor or Mach3 T-bar razors. (7) A wire wrap guard structure as shown in a few of the embodiments for reducing the likelihood of nicks or cuts while shaving, may be provided on the other embodiments. If desired, the blade sharp edges of my in-line safety razor shaving devices may be guarded in further ways in addition to the front and rear elongated guard bars. For example, the sharpened edge of the razor blade may be wrapped in a protective sleeve or casing, that exposes most of the blade while providing the user with a protective barrier over a portion of the sharpened edge to reduce, possibly further, the chance of accidental nicks or cuts. Examples of such sleeves are shown in U.S. Pat. No. 3,263,330 to Ferrara, which is hereby incorporated herein by reference.

Those in the art should appreciate that in-line safety straight razor shaving devices may be used with accessories, including the trimming cages and carrying cases, such as those of the type shown in my U.S. Pat. No. 5,673,711. Also, the in-line safety straight razor shaving devices disclosed herein can be profitably used for other hair shaving applications, including shaving the peripheries sideburns, short beards, goatees, and even eyebrows. Those in the art should realize also that my shaving devices can also be used for selected pet grooming applications or surgical procedures calling for a close shave.

Thus, it is to be understood that the in-line safety straight razor devices of the present invention are by no means limited to the particular constructions and uses herein disclosed and/or shown in the drawings. Instead, the present invention also encompasses any modifications or equivalents that are fairly covered by the claims set forth below.

I claim:

1. An in-line double-sided manual shaving safety straight razor blade device, having a single head with at least dual razor-sharp blade edges, connected to and supported by a handle portion arranged generally in-line therewith, for shaving of the face or other areas of the body, the razor device comprising:

an elongated frame having an elongated front cutter support portion and an elongated rear handle portion, the front cutter support portion having a longitudinal axis and the rear handle portion having a longitudinal axis arranged generally in-line by virtue of the axes of the cutter support portion and rear handle portion being generally located in a common plane, the front cutter support portion having first and second sides; and first and second elongated razor blade structures respectively mounted upon the first and second sides of the front cutter support portion in generally opposed relation such that only one of the first and second razor blade structures may be in use at any one time, and each razor blade structure including at least a first elongated razor blade having a razor-sharp edge and elongated front and rear guards spaced from each other and the razor-sharp blade edge.

2. A double-sided safety straight razor as in claim 1, wherein each of the elongated razor blade structures includes a second elongated razor blade having a razor-sharp edge, the razor-sharp edge of the second razor blade being spaced from and generally parallel to the razor-sharp edge of the first razor blade and also being spaced from the front and rear guards.

3. A double-sided safety straight razor as in claim 2, wherein:

the razor blades are each formed from a very thin strip of metal alloy having a single razor-sharp edge, the razor blades each are arranged in a blade plane that is spaced from the other blade plane, the first and second razor blade of each razor blade structure are generally arranged parallel to one another, and the elongated razor blade structures each include spacer means for keeping the first and second razor blades of that blade structure separated from one another by a predetermined distance.

4. A double-sided safety straight razor as in claim 2, wherein the longitudinal axis of the front cutter portion and the longitudinal axis of the rear handle portion are offset from one another.

5. A double-sided safety straight razor as in claim 2, wherein the longitudinal axis of the front cutter portion and the longitudinal axis of the rear handle portion are substantially in-line with one another.

6. A double-sided safety straight razor as in claim 1, wherein the front guards of the first and second razor blade structures are formed as a unitary guard member, with the front guard of the first razor blade structure comprising one-half of the unitary guard member and the front guard of the second razor blade structure comprising the other half of the unitary guard member.

7. A double-sided safety straight razor as in claim 1, wherein:

the first razor blade of the first razor blade structure is disposed in a first blade plane, and the first razor blade of the second razor blade structure is disposed in a second blade plane which is distinct from, spaced apart from, and essentially parallel to the first blade plane.

8. A double-sided safety straight razor as in claim 1, wherein:

the first razor blade of the first razor blade structure is disposed in a first blade plane, and the first razor blade of the second razor blade structure is disposed in a second blade plane, and the first and second blade planes are essentially at an acute angle to one another of less than about 45 degrees, such that the blade planes intersect at an imaginary line of intersection spaced from the razor-sharp edges of the first razor blades of the first and second razor blade structures, and the imaginary line of intersection is generally parallel to the longitudinal axis of the front cutter portion.

9. A double-sided safety straight razor as in claim 1, wherein:

the exposed razor-sharp edge of each first razor blade is at least 35 mm (about 1.4 inches) long, and is arranged along a straight line which is distinct from the straight line of the other first razor blades, the razor blade edges of the first razor blades are substantially parallel to one another.

10. A double-sided safety straight razor as in claim 1, wherein the exposed razor-sharp edge of each razor blade is at least 50 mm (about two inches) long.

11. A double-sided safety straight razor as in claim 1, wherein:

the elongated front guard of each razor blade structure is at least 25 mm (about 1 inch) long, the elongated rear guard of each razor blade structure is at least about 25 mm (about 1 inch) long, the elongated front and rear guards of each razor blade structure are all of essentially the same length, the first and second razor blade structures are essentially mirror images of one another on opposite sides of the front cutter portion, the elongated frame is at least 150 mm (about six inches) long, and the elongated rear handle portion is at least about 100 mm (about 4 inches) long.

12. A safety straight razor blade device as in claim 1, wherein:

the handle structure and the razor head are permanently attached to one another, and at least part of the handle portion, at least part of the front cutter support portion, and at least part of the razor head structure are integrally formed of the same molded plastic material.

13. A safety straight razor blade device as in claim 1, wherein:

the razor blade structures are constructed as removably detachable razor blade cartridges, whereby, after the razor blades of the cartridge structures have been used on one person, they may be removed and replaced with fresh unused cartridge structures for use on the next person to be shaved.

14. A safety straight razor blade device as in claim 13, where the razor blade structures are constructed to be fully symmetrical about a transverse center plane, such that the first and second elongated razor blade cartridge structures may be removed from the front cutter support portion, and interchanged.

15. A safety straight razor blade device as in claim 2, wherein each razor blade structure includes:

an elongated base platform member, the first razor blade, which blade is generally elongated, flat and rectangular, spacer means for separating the first and second razor blades, the second razor blade strip, which blade is generally elongated, flat and rectangular, and of a length substantially equal to the length of the first razor blade and is laterally offset from the first razor blade, and an elongated cap member having a length at least about as long as the first and second razor blades.

16. A safety straight razor blade device as in claim 2, wherein each rear guard includes an elongated lubricant strip.

17. A safety straight razor blade device as in claim 1, wherein:

the front cutter support portion includes an elongated central member having first and second generally opposed, substantially parallel sides, the first elongated razor blade structure is connected to the first side of the front cutter support portion, and the second elongated razor blade structure is connected to the second side of the front cutter support portion, and the elongated central member includes a plurality of through-hole apertures located generally above the front guards of the razor blade structures, whereby cut hair stubble and other shaving debris may be deflected, and pass-through to the other side of the front cutter support portion.

18. A safety straight razor blade device as in claim 1, wherein:

the first and second razor blade structures are constructed as removable razor blade cartridges;

each side of the front cutter support portion includes a base portion provided with a cartridge connection mechanism for receiving and supporting the razor blade cartridge attached to that side, each cartridge includes first and second razor blade strips, and each cartridge includes a platform structure arranged for supporting its first and second razor blade strips, the platform structure including a base-connecting mechanism which interlockingly engages with the cartridge connection mechanism of the base portion.

19. A safety straight razor blade device as in claim 18, wherein:

the razor blade cartridges are each conventional dual-razor blade strip cartridges with lubricant strips provided on the rear guards, and the razor blade cartridges which are each arranged to be removably attachable by a user to front cutter support portion, whereby, when the razor blade strips become dull or contaminated, the entire cartridge may be readily replaced with a fresh cartridge with clean razor blade strips.

20. A safety straight razor blade device as in claim 18 wherein:

the first and second razor blade cartridges respectively have first and second face portions that include substantially flat surface areas on their respective front and rear guard portions, which pairs of front and rear portions correspond to first and second working planes, the first and second face portions being tilted from one another by no more than about 45 degrees, such that the razor-sharp edges of the cartridges point slightly away from the common plane.

21. An in-line manual shaving safety straight razor blade device, having a single head with at least dual razor-sharp blade edges, connected to and supported by a handle portion arranged generally in-line therewith, for shaving of the face or other areas of the body, the razor device comprising:

an elongated frame having an elongated front cutter support portion and an elongated rear handle portion, the front cutter support portion having a longitudinal axis and the rear handle portion having a longitudinal axis arranged generally in-line by virtue of the axes of the cutter support portion and rear handle portion generally being located in the same plane, the front cutter support portion having first and second sides; and a first elongated razor blade structure being connected to and supported by the front cutter support portion, the razor blade structure including (a) at least a first elongated razor blade with a first razor-sharp blade edge, (b) a second elongated razor blade with a second razor-sharp blade edge, the second razor blade being spaced from and generally parallel to the first razor blade, (c) an elongated front guard member spaced from the razor-sharp blade edges, (d) an elongated rear guard member spaced from the razor-sharp blade edges, and from the front guard member.

22. A safety straight razor blade device as in claim 21, wherein the first and second elongated razor blades are each formed from substantially flat, very thin, substantially rectangular strips of metal alloy having two parallel sides.

23. A safety straight razor blade device as in claim 21, wherein:

the longitudinal axis of the front cutter portion and the longitudinal axis of the rear handle portion are offset from one another, and the front guard member is located further away from the longitudinal axis of the rear handle portion than is the elongated rear guard member.

24. A safety straight razor blade device as in claim 21, further comprising:

a second elongated razor blade structure being connected to and supported by the front cutter support portion, the second razor blade structure including (a) a first elongated razor blade with a first razor-sharp blade edge, (b) a second elongated razor blade with a second razor-sharp blade edge, the second razor blade being spaced from and generally parallel to the first razor blade, (c) an elongated front guard member spaced from the razor-sharp blade edges, and (d) an elongated rear guard member spaced from the razor-sharp blade edges, and from the front guard member.

25. A safety straight razor blade device as in claim 24, wherein:

the front cutter support portion includes an elongated central member having first and second generally opposed, substantially parallel sides, the first elongated razor blade structure is connected to the first side of the front cutter support portion, and the second elongated razor blade structure is connected to the second side of the front cutter support portion.

26. A safety straight razor blade device as in claim 25, wherein:

the elongated central member of the front cutter support portion includes a generally straight rounded elongated portion at one end thereof, the rounded elongated portion forming at least part of the front guard members of the first and second elongated razor blade structures.

27. A safety straight razor blade device as in claim 21, further comprising:

wire guard means for further shielding skin to be shaved from inadvertently cutting during use of the shaving device, and wherein the wire guard means includes several substantially parallel thin wire sections spaced from one another, the thin wire sections being at least partially exposed and in view, and the exposed portions of the thin wire sections are arranged to cross over the razor-sharp edges of the first and second razor blades, thereby helping prevent a portion of skin to be shaved from inadvertently being cut by the razor-sharp edges of the first and second razor blades.

28. A safety straight razor blade device, as in claim 21, wherein:

the front and rear guard portions define at least in part a working plane in which the razor-sharp edges of the first and second razor blades project.

* * * * *

UNITED STATES PATENT AND TRADEMARK OFFICE

CERTIFICATE OF CORRECTION

PATENT NO. : 6,164,290
DATED : December 26, 2000
INVENTOR(S) : Edward A. Andrews It is certified that error appears in the above-identified patent and that said Letters Patent is hereby corrected as shown below:

Column 1,
Line 43, "stopping" should be -- stropping --.

Column 2,
Line 54, delete "be".

Column 6,
Line 20, before "present" insert -- the --.

Column 7,
Line 10, "been" should be -- being --.
Line 59, "device" should be -- devices --.

Column 8,
Line 67, "show of" should be -- shows --.

Column 9,
Line 29, "handle=s" should be -- handle's --.

Column 10,
Line 66, "at" should be -- as --.

Column 11,
Line 16, after "This" delete "is".

Column 12,
Line 67, after "may" insert -- be --.

Column 15,
Line 21, after "used" delete "to".

Column 16,
Line 3, after "toward" delete "to".
Line 46, "402" should be -- 1402 --.

UNITED STATES PATENT AND TRADEMARK OFFICE

CERTIFICATE OF CORRECTION

PATENT NO. : 6,164,290
DATED : December 26, 2000
INVENTOR(S) : Edward A. Andrews It is certified that error appears in the above-identified patent and that said Letters Patent is hereby corrected as shown below:

Column 18,
Line 16, delete "and".

Column 19,
Line 17, before "razor" insert -- " --.

Signed and Sealed this

Twenty-third Day of April, 2002

*Attest:*

*Attesting Officer*

JAMES E. ROGAN
*Director of the United States Patent and Trademark Office*